United States Patent [19]

Fike

[11] Patent Number: 5,022,577

[45] **Date of Patent: * Jun. 11, 1991**

[54] LINE STORAGE AND DISPENSING CARTRIDGE

[76] Inventor: Richard A. Fike, 62 S. Lake, Madison, Ohio 44057

[ * ] Notice: The portion of the term of this patent subsequent to Jul. 4, 2006 has been disclaimed.

[21] Appl. No.: 487,850

[22] Filed: Mar. 5, 1990

[51] Int. Cl.[5] ..... B26D 7/00; B65D 85/04

[52] U.S. Cl. ..... 225/47; 225/39; 225/46; 30/289; 83/436

[58] Field of Search ..... 225/17, 39, 46, 49, 225/52, 53, 47, 51; 30/289, 225; 132/323; 83/436

[56] References Cited

U.S. PATENT DOCUMENTS 1,805,619 5/1931 Fuller ..... 83/436
2,260,962 10/1941 White ..... 225/40
4,108,390 8/1978 Hayes ..... 225/52
4,844,373 7/1989 Fike ..... 206/389

*Primary Examiner*—Frank T. Yost
*Assistant Examiner*—Allan Schrock
*Attorney, Agent, or Firm*—D. Peter Hochberg; Mark Kusner; Louis J. Weisz

[57] ABSTRACT

A disposable, cord dispensing cartridge comprised of a rigid, shatterproof plastic housing including first and second housing sections having inner and outer surfaces which are ultrasonically secured to each other. The housing includes an internal cord-holding cavity of cylindrical shape dimensioned to receive a spool having two circular flange portions connected by a stem portion. The spool is dimensioned to retain a predetermined length of high strength, small diameter cord which is machine-wound in dense-packed fashion thereon.

6 Claims, 4 Drawing Sheets

LINE STORAGE AND DISPENSING CARTRIDGE

FIELD OF THE INVENTION

The present invention relates to a compact container for cord and the like, and more particularly, to a lightweight, portable cord containing and dispensing device.

BACKGROUND OF THE INVENTION

The present invention relates to a cord storage and dispensing device of a type disclosed in my prior U.S. Pat. No. 4,844,373 entitled LINE STORAGE AND DISPENSING DEVICE, which issued on July 4, 1989, the disclosure of which is expressly incorporated by reference herein. The present invention provides a cord dispensing cartridge as described in U.S. Pat. No. 4,844,373, which cartridge includes the improvements of reinforcing means to strengthen the cartridge, flotation means to enable the cartridge to float, and means fixedly mounted to said cartridge for severing lengths of cord from said cartridge.

SUMMARY OF THE INVENTION

In accordance with the present invention, there is provided a disposable, cord dispensing device comprising a rigid, shatterproof plastic housing including first and second housing sections having inner and outer surfaces which are ultrasonically secured to each other, the housing defining an internal cord holding cavity of cylindrical shape. A spool having two circular flange portions connected by a stem portion is provided to be received within the cylindrical cavity of the housing and to freely rotate therein. The spool is retained within the cavity, and a predetermined length of high strength, small diameter cord is machine-wound in dense-packed fashion thereon. An end of the cord passes through the housing and is accessible for use. Blade means are fixedly mounted to said housing to sever lengths of cord from the cartridge, the blade means being disposed below the outer surface of the housing.

In accordance with another aspect of the present invention, there is provided a device as defined above wherein the housing further includes flotation means to enable the cartridge to float.

In accordance with another aspect of the present invention there is provided reinforcing means extending through a cylindrical cavity between the first and second housing section.

It is an object of the present invention to provide a cord dispensing device for storing and dispensing high-strength, small diameter line or cord for use by individuals, military personnel, public safety forces and the like.

Another object of the present invention is to provide a device as described above wherein the cord is capable of being worn by an individual with the cord being immediately available for use.

Another object of the present invention is to provide a device as described above which includes high strength, fire resistant nylon cord suitable for a wide variety of uses and applications stored in a compact, lightweight dispenser.

Another object of the present invention is to provide a device as described above wherein the cord is carried in a disposable plastic cartridge which floats in water.

A still further object of the present invention is to provide a device as described above which includes means for severing length of cord, which means for severing is fixedly mounted to the cartridge.

An even further object of the present invention is to provide a cord dispensing device as described above having improved structural strength.

Another object of the present invention is to provide a device as defined above which is inexpensive to manufacture, and simple and easy to use.

These and other objects and advantages will become apparent from the following description of preferred embodiments taken together with the accompanying drawings.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
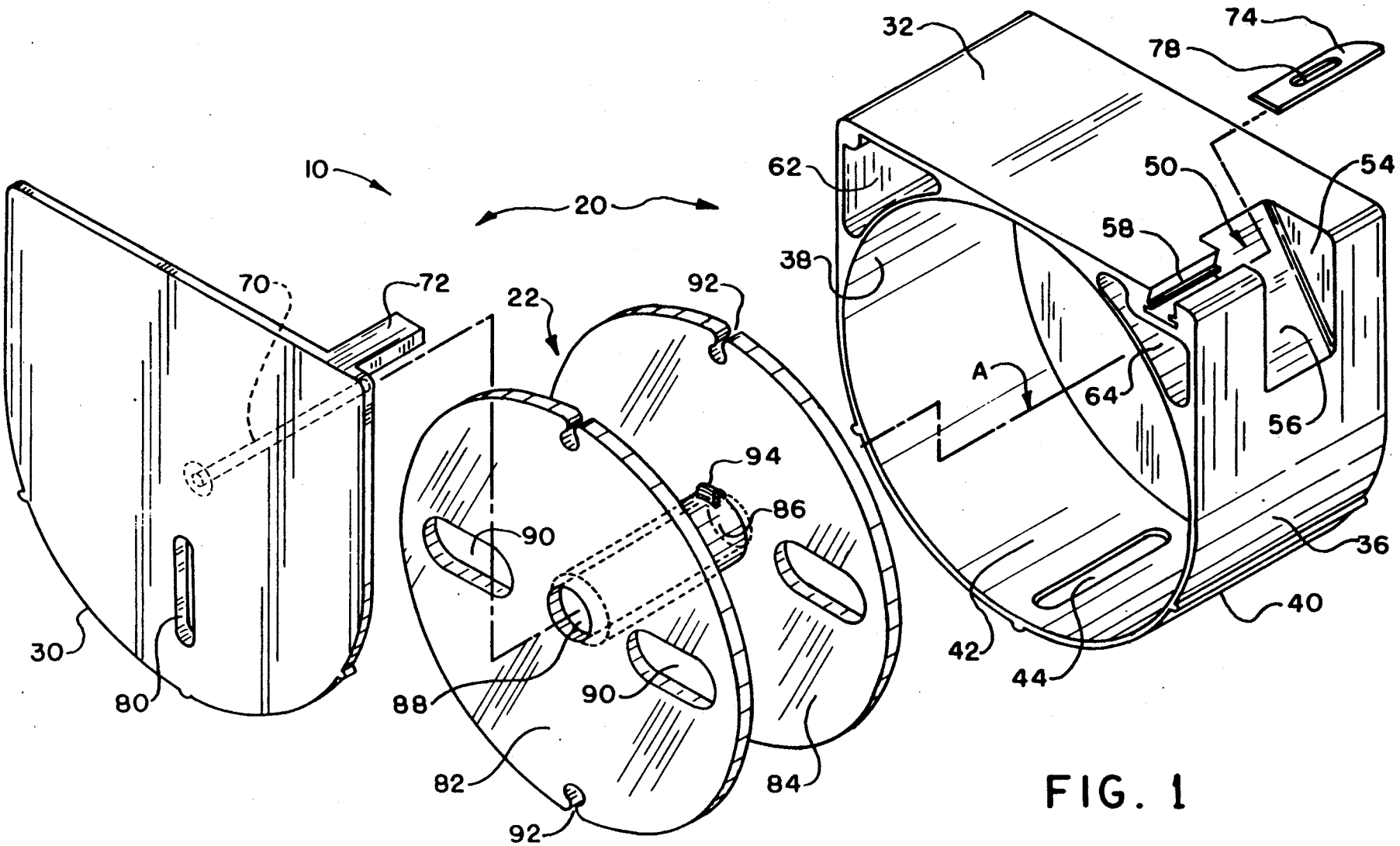
FIG. 1 is an exploded perspective view of a cord storage and dispensing cartridge illustrating a preferred embodiment of the present invention.

Referring now to the drawings wherein the showings are for the purpose of illustrating preferred embodiments of the invention only and not for the purpose of limiting same, FIG. 1 illustrates a cord for storing and dispensing cartridge 10 according to a preferred embodiment of the present invention. Cartridge 10 is generally comprised of a housing 20 and a spool 22 adapted to be received therein. Housing 20 includes a front wall section 30, an upper wall section 32, a rear wall section 34, and a U-shaped wall section 36 defining the lower and lateral surfaces of housing 20. In the embodiment shown wall sections 32, 34, and 36 are molded or otherwise formed into an integral housing member designated 40. Front wall section 30 is a separate member dimensioned for attachment to housing member 40. Housing member 40 includes an internal, semi-circular inner wall 38 which is formed to join upper wall section 32 and U-shaped wall section 36, wherein inner wall 38 and wall section 36 define a cylindrical cavity 42 for receiving spool 22 therein. Cavity 42 is generally symmetrical about an axis A which extends through housing 20 between front wall section 30 and rear wall section 34. An elongated aperture 44 is provided through the lower portion of U-shaped wall section 36. Aperture 44 extends between front and rear wall sections 30, 34, as best seen in FIG. 1.

A recess 50 is formed in the upper corner of housing 40. Recess 50 includes front and rear surfaces 52, 54 which are disposed generally parallel to front and rear wall sections 30, 34, respectively, and a bottom surface 56 which extends from upper wall section 32 to U-shaped wall section 36. Housing member 40 also includes a generally T-shaped slot 58 formed in upper wall section 32. Slot 58, best illustrated in cross section in FIG. 6, extends from the front edge of housing 40 into recess 50.

Figure 2:
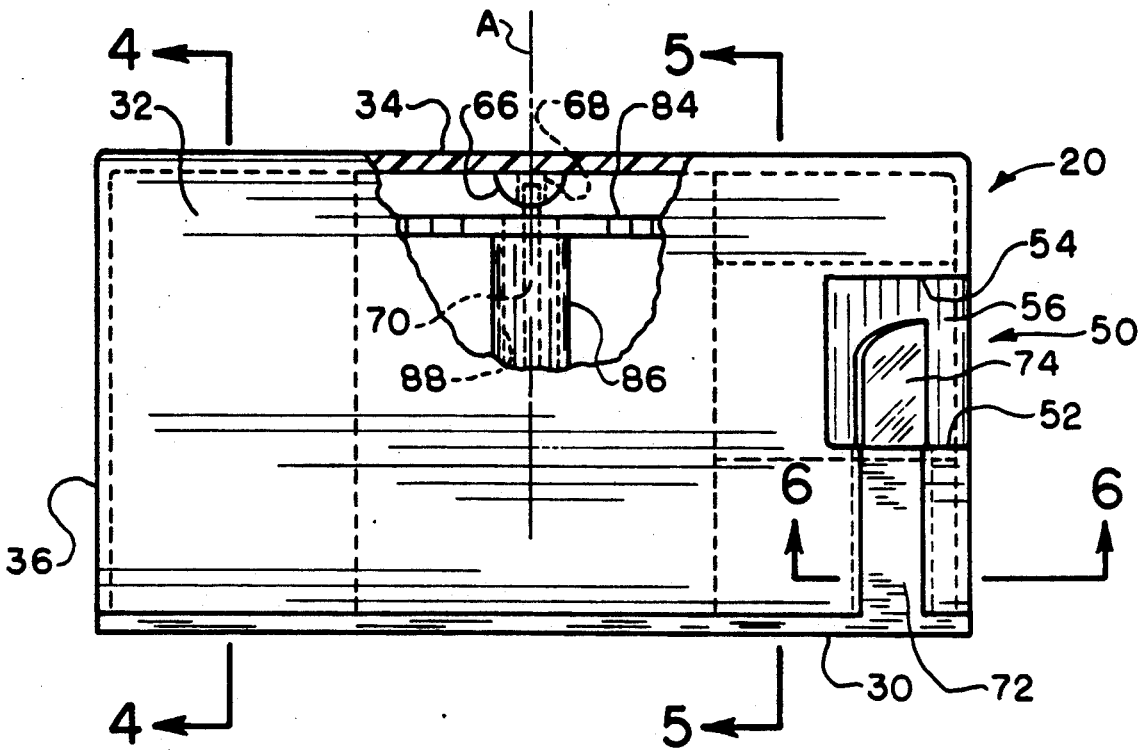
FIG. 2 is an enlarged, partially sectioned, plan view of the cord storage and dispensing cartridge shown in FIG. 1.
Figure 3:
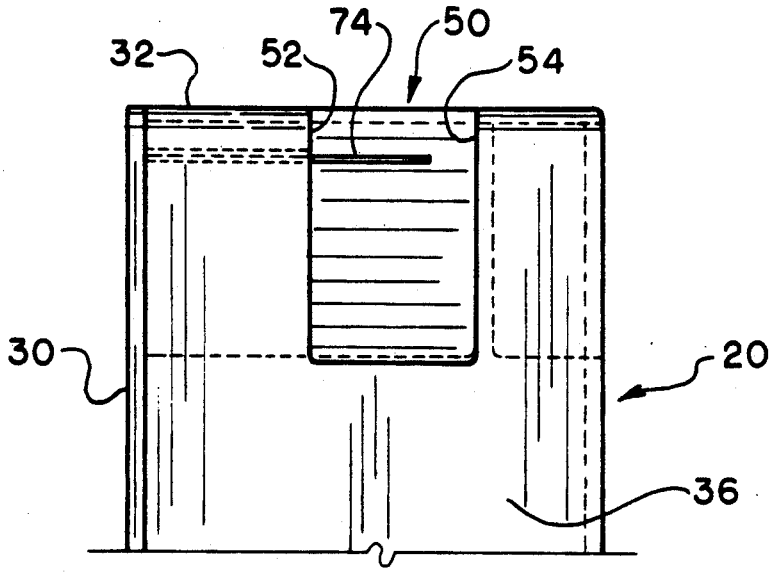
FIG. 3 is a partial, side elevational view of the cartridge shown in FIG. 2.
Figure 4:
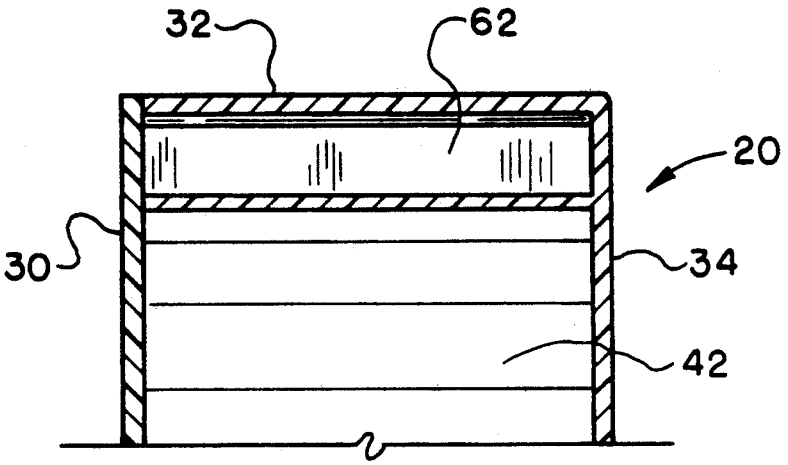
FIG. 4 is a sectional view taken along line 4—4 of FIG. 2.
Figure 5:
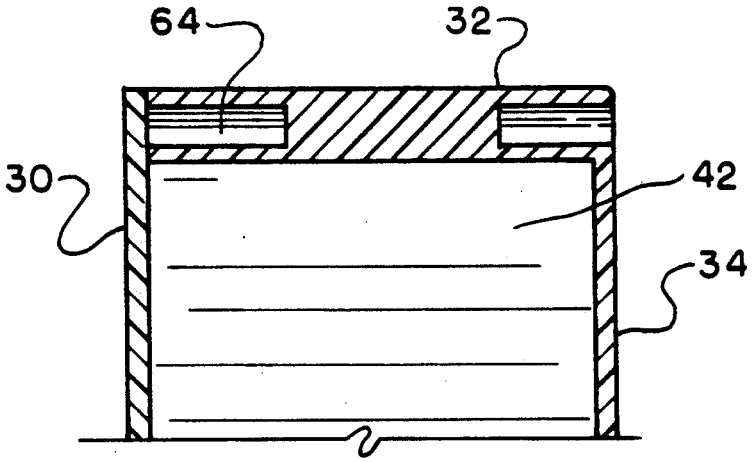
FIG. 5 is a sectional view taken along line 5—5 of FIG. 2.

According to a preferred embodiment of the present invention, first and second cavities 62, 64 are formed in housing 40. Cavity 62 is formed between inner wall 38 and wall sections 32, 36. Cavity 62, best seen in FIG. 4, extends from the front edge of housing member 40 to rear wall section 34. Cavity 64 is similarly formed, but extends only from the front edge of housing member 40 to the wall-forming recess 50, as best seen in FIG. 5. A boss 66, best seen in FIG. 2, is provided within cavity 42 on the inner surface of rear wall section 34. Boss 66 includes a bore 68 axially aligned along axis A.

Figure 6:
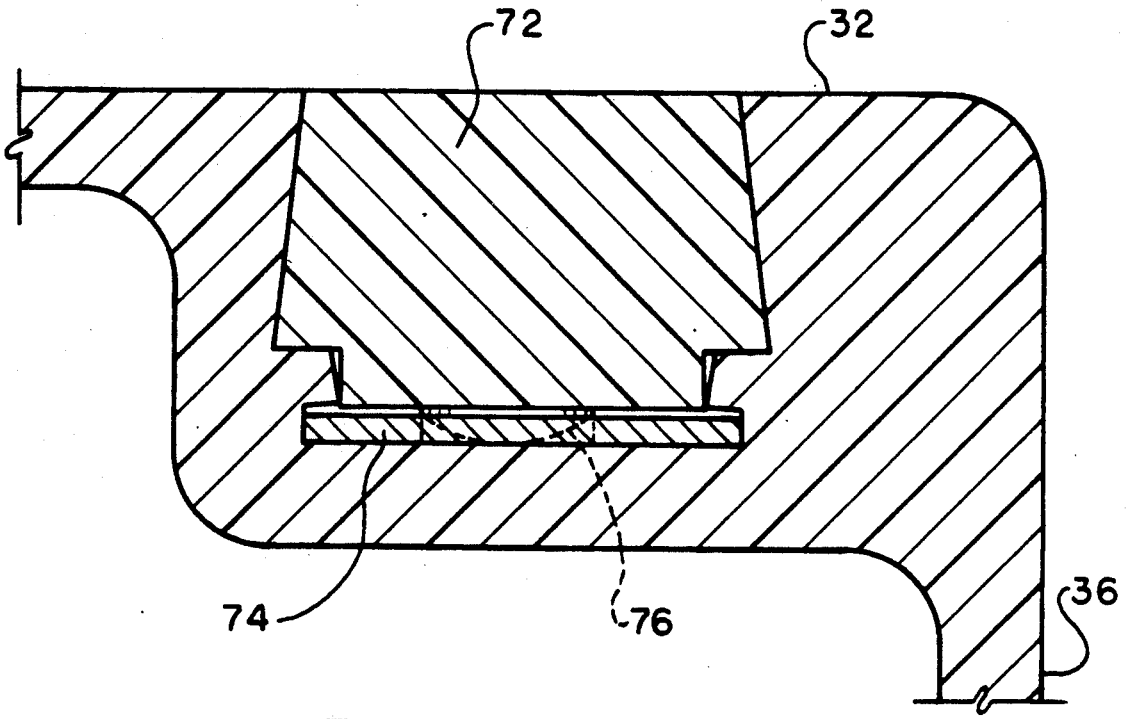
FIG. 6 is a sectional view taken along line 6—6 of FIG. 2.

Referring now to front wall section 30, an elongated reinforcing member 70 (shown by hidden lines in FIG. 1) extends from the inner surface thereof. Member 70 is positioned to extend along axis A between front and rear wall sections 30, 34 and to be received in bore 68 of boss 66 as seen in FIG. 2, when front wall section 30 is joined to housing member 40. A tab 72 is provided on the edge of wall section 30, which tab 72 is dimensioned to be received in T-shaped slot 58 in housing member 40. Tab 72 is operable to confine a blade 74 between tab 72 and housing member 40, as best seen in FIG. 6. In this respect, to fixially locate blade 74 within housing 20, a rounded protrusion 76 is provided on the lower surface of tab 72, which protrusion 76 is dimensioned to be received in an opening 78 in blade 74. Blade 74 is preferably disposed with the cutting edge thereof facing housing 20 a distance such that a cord drawn into recess 50 and across surface 56, i.e. along the curved portion of the blade, would begin to be severed. Front wall section 30 also includes an elongated slot 80 extending therethrough.

Spool 22 includes two circular flange portions 82, 84 connected by a stem portion 86. An axially aligned bore 88 extends through stem portion 86, as best seen in FIG. 1. Flange portions 82, 84 each include elongated slots 90 radiating outward from the centers of the flange portions to the peripheral edges thereof. Circular recesses 92 are provided on the peripheral edges of flange portions 52, 54 for receiving the free end of the cord which is wound on spool 22, which facilitates handling of spool 22 and the cord during storage and assembly. A generally hook-shaped member 94 is provided on stem 86 and is dimensioned to grip a portion of cord. In this respect, hook-shaped member 94 is utilized in the process of winding the cord onto spool 22, as has been described in Applicant's prior U.S. Pat. No. 4,844,373, which is incorporated herein by reference.

Spool 22 is dimensioned to have a high strength nylon cord (not shown) or the like wound thereon. Such a cord is disclosed in U.S. Military specification MIL-C-5040F dated Mar. 23, 1981, the disclosure of which is incorporated by reference herein. (Copies of such specification are available from the U.S. Army Natick Research and Development Laboratories, Natick, Mass. 01760. A more complete description of the cord and the winding procedure for placing same on spool 22 are set forth in Applicant's prior U.S. Pat. No. 4,844,373 which is expressly incorporated by reference herein.

Spool 22, with the cord wrapped thereon, is disposed within cylindrical cavity 42 of U-shaped housing 40. The free end of the cord (not shown) passes through elongated opening 44. Front wall section 30 is secured to housing member 40 with spool 22 confined between U-shaped wall section 36 and front wall section 30. In this respect, reinforcing member 70 extends through bore 88 of spool 22 generally without engagement therewith and is received in bore 68 of boss 66. Member 70 thereby provides lateral support for the wall sections 30, 34. As indicated above, tab 72 is received in T-shaped slot 58 to lock blade 74 in position in recess 50. Front wall section 30 may be glued to housing member 40, but in the preferred embodiment is ultrasonically welded thereto. In this respect, wall section 30 is preferably secured to housing member 40 such that cavities 62, 64 are airtight. Housing member 40 and spool 22 are dimensioned such that spool 22 freely rotates therein. In normal operation, the peripheral edges the flange portions 52, 54 slide along the curved inner surface of U-shaped wall section 36 and inner wall 38.

Housing 20 is preferably formed of a rigid, structural plastic material which is shatterproof and of sufficient dimensional stability to withstand a dead weight of approximately 500 lbs., and which is able to withstand temperature extremes of −40° F. to 260° F. without shattering or rupturing. In this respect, housing 20 may be molded or otherwise formed from such polymers as polyesters, polycarbonates, or polyacrylates. It is intended for the purposes of the present invention that the term "polymer" includes copolymers, polymer mixtures and homopolymers. Because spool 22 is disposed within housing 20 and has no load bearing function, it may be made from plastic material of lesser structural integrity such as polystyrene, polypropylene, polyethylene, or the like. In the preferred embodiment, both spool 22 and housing 20 are formed of an acetal polymer material. With such material, the thickness of wall sections 30, 32, 34, and 36 of the embodiment shown are approximately five hundredths (0.05) inches.

As set forth above in U.S. Pat. No. 4,844,373, the disclosure of which is incorporated by reference herein, cartridge 10 is adapted to be received in a pouch or case which may be formed from canvas, nylon, leather or the like.

The present invention represents an improvement over my previously patented cord storage and dispensing device by providing a cartridge which includes several novel features, such as reinforcing means to substantially increase the strength of the cartridge and flotation means which enables the present device to float in water. With respect to the latter, cavities 62, 64 provide flotation means which enable cartridge 10 to float even though cylindrical cavity 42 may be filled with water. Still further, the present invention provides a quick and easy means for severing lengths of cord from cartridge 10. Importantly, blade 74 faces inwardly, i.e. toward housing 20 and is recessed below the outer surface thereof. Consequently, a length of cord can be easily severed by drawing the cord into recess 50 between the cutting edge of blade 74 and recess surface 52 and pulling the cord to be severed against blade 74. Such an arrangement provides a quick and simple means of severing lengths of cord while orienting blade 74 at a position wherein contact with the user is almost impossible. Other improvements include apertures 80 and 90 which provide means for monitoring the amount of cord in cartridge 10, and elongated aperture 44 which provides a dispensing guide or track to ensure problem free dispensing of the cord. The present invention thus provides a cord storage and dispensing cartridge having improved structural strength, flotation means to enable a cartridge to float, means fixially mounted on the cartridge for quickly and easily severing lengths of cord from the cartridge and several other features not known heretofore.

The present invention has been described with respect to preferred embodiments. Modifications and alterations will occur to others upon the reading and understanding of the specification. It is intended that all such modifications and alterations be included insofar as they come within the scope of the patent as claimed or the equivalents thereof.

Having thus described the invention, the following is claimed:

1. A cord dispensing cartridge comprising:

a rigid, shatter-proof, generally U-shaped plastic housing, said housing including:

first and second housing sections having inner and outer surfaces, which housing sections are ultrasonically welded to each other and define a cord holding cavity of cylindrical shape and a plurality of separate, smaller, air-tight flotation cavities within said plastic housing;

a spool having two flat, circular flange portions connected by a small-diameter stem portion totally enclosed within said housing, said spool dimensioned to occupy substantially the entire space defined by said cylindrical cavity;

a predetermined length of high-strength nylon cord machine wound in dense-packed fashion about said stem portion of said spool; and, blade means operable to sever said nylon cord, said blade means being stationary and fixedly mounted to said housing by being wedged between said first housing section and said second housing section with a cutting edge oriented inwardly toward said housing and disposed within said outer surface of said housing.

2. A cartridge as defined in claim 1 wherein said housing includes an elongated slot disposed therein through which said nylon cord passes said slot extending generally parallel to said stem portion of said spool.

3. A cartridge as defined in claim 1 further comprising support means integrally formed with said first housing section extending axially through said cylindrical cavity between said first and second housing sections.

4. A cord dispensing cartridge comprising:

a rigid, shatter-proof plastic housing including first and second housing sections having inner and outer surfaces, which are ultrasonically welded to each other and which define a cord-holding cavity of cylindrical shape, one of said housing sections including support means integrally formed therewith extending axially through said cylindrical cavity between said first and second housing sections;

a spool having two flat, circular flange portions connected by a small-diameter stem portion totally enclosed within said cylindrical cavity of said housing, said spool including a longitudinally extending aperture therethrough dimensioned to receiving said support means therein;

a predetermined length of high-strength nylon cord packed about said stem portion of said spool; and, blade means having a cutting edge operable to sever said nylon cord, said blade means being stationary and fixedly mounted to said housing by being wedged between said first housing section and said second housing section and disposed within a recess in said outer surface of said housing with said cutting edge oriented inwardly toward said housing.

5. A device as defined in claim 4 wherein said support means comprises an elongated post integrally formed with said first housing section extending from said inner surface of said first housing section, wherein said mandrel is receivable into said aperture of said spool.

6. A device as defined in claim 4 wherein said housing includes an elongated slot disposed therein through which said nylon cord passes, said slot extending generally parallel to said stem portion of said spool.

* * * * *